US007147143B2

(12) United States Patent
Cargile

(10) Patent No.: US 7,147,143 B2
(45) Date of Patent: Dec. 12, 2006

(54) OPENING ASSIST TO DISPENSING CARTON

(75) Inventor: John W. Cargile, Decature, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 270 days.

(21) Appl. No.: 10/632,372

(22) Filed: Aug. 1, 2003

(65) Prior Publication Data

US 2005/0023333 A1 Feb. 3, 2005

(51) Int. Cl.
*B65D 5/72* (2006.01)
*B65D 17/28* (2006.01)

(52) U.S. Cl. ..... 229/122; 206/427; 221/302; 229/160.2; 229/242

(58) Field of Classification Search ..... 229/122, 229/122.1, 160.2, 240–244; 206/427; 221/302, 221/305

See application file for complete search history.

(56) References Cited

U.S. PATENT DOCUMENTS 3,265,283 A * 8/1966 Farquhar ..... 229/122.1
3,712,533 A * 1/1973 Skillen ..... 229/244
4,396,143 A 8/1983 Killy
5,265,798 A 11/1993 DeMaio et al.
5,292,059 A 3/1994 Oliff
5,385,234 A * 1/1995 Stout et al. ..... 206/427
6,105,854 A 8/2000 Spivey et al.
6,176,419 B1 1/2001 Holley, Jr.
6,478,219 B1 11/2002 Holley, Jr.
6,578,736 B1 * 6/2003 Spivey ..... 221/305
6,866,185 B1 * 3/2005 Harrelson ..... 221/305
6,869,009 B1 * 3/2005 Sutherland et al. ..... 229/122
6,902,104 B1 * 6/2005 Holley et al. ..... 229/242
6,929,172 B1 * 8/2005 Bates et al. ..... 229/244
2002/0070139 A1 * 6/2002 Bates ..... 206/427
2003/0141313 A1 * 7/2003 Bates ..... 206/427

* cited by examiner

*Primary Examiner*—Gary E. Elkins
(74) *Attorney, Agent, or Firm*—Tsugihiko Suzuki

(57) ABSTRACT

An opening assist for a dispensing carton to facilitate the opening of the carton to dispense articles without unintentional tearing of the carton. The dispensing carton includes a plurality of panels hingedly connected to one another. A displaceable portion is detachably connected to an end of the carton to define an opening for exposing an endmost article for removal from the carton end. The displaceable portion is at least partially defined by a frangible line on the carton end. An opening assist is defined in the carton end at least partially along the frangible line to facilitate the opening of the dispensing carton via the displaceable portion.

18 Claims, 5 Drawing Sheets

OPENING ASSIST TO DISPENSING CARTON

BACKGROUND OF THE INVENTION

The present invention relates generally to paperboard cartons for use in packaging articles and, more particularly, relates to a dispensing carton having an opening assist to facilitate the use of the dispensing feature of the carton.

Cartons are useful for allowing consumers to purchase, transport and store a desired quantity of articles such as soft drinks. For the convenience of the consumer, some cartons have dispensers which allow the articles to be removed one at a time while continuing to encase the remaining articles. A portion of the carton is torn out to form an opening from which articles may be dispensed.

For example, the carton is pulled open by tearing across the top of the erected carton. Typically, the consumer tears along the top of the carton by inserting fingers through a tear line in order to pull open the dispenser. The carton is then torn down along each of the side walls of the erected carton to define a dispensing trough for retaining each article as it is about to be dispensed. The dispensing trough is hingedly connected along a line of perforations extending across the carton end and may be completely removed from the carton by tearing along the perforations.

However, when forming the opening in the carton to dispense articles from the dispenser, the perforations along the carton end often allow unintended paper tears. Also, seams created by overlapping edges of end flaps which form the end of the carton may make removal of the trough from the carton more difficult. In either case, other panels may be torn out which leads to failure of the dispensing trough. Failure of the trough could lead to the articles rolling out of the carton prematurely.

Therefore, there is a need for a carton having an improved dispenser that allows the consumer to more easily open the carton for dispensing articles, without unintended paper tears, while continuing to facilitate easy access to the articles to be dispensed from the carton.

SUMMARY OF THE INVENTION

The present invention provides a dispensing carton having an opening assist cooperating with the dispensing feature of the carton to facilitate the opening of the carton without causing unintended paper tears. The opening assist allows the consumer to punch in an area of the carton prior to or during the opening of the carton for dispensing articles.

Generally described, the carton of the present invention includes a plurality of panels hingedly connected to one another. A displaceable portion or trough is detachably connected to an end of the carton to define an opening for exposing an endmost article for removal from the carton end. The displaceable portion is at least partially defined by a frangible line on the carton end. An opening assist is defined in the carton end at least partially along the frangible line. The opening assist facilitates the opening of the dispensing carton via the displaceable portion for dispensing articles without unintentional tearing of the dispensing carton.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
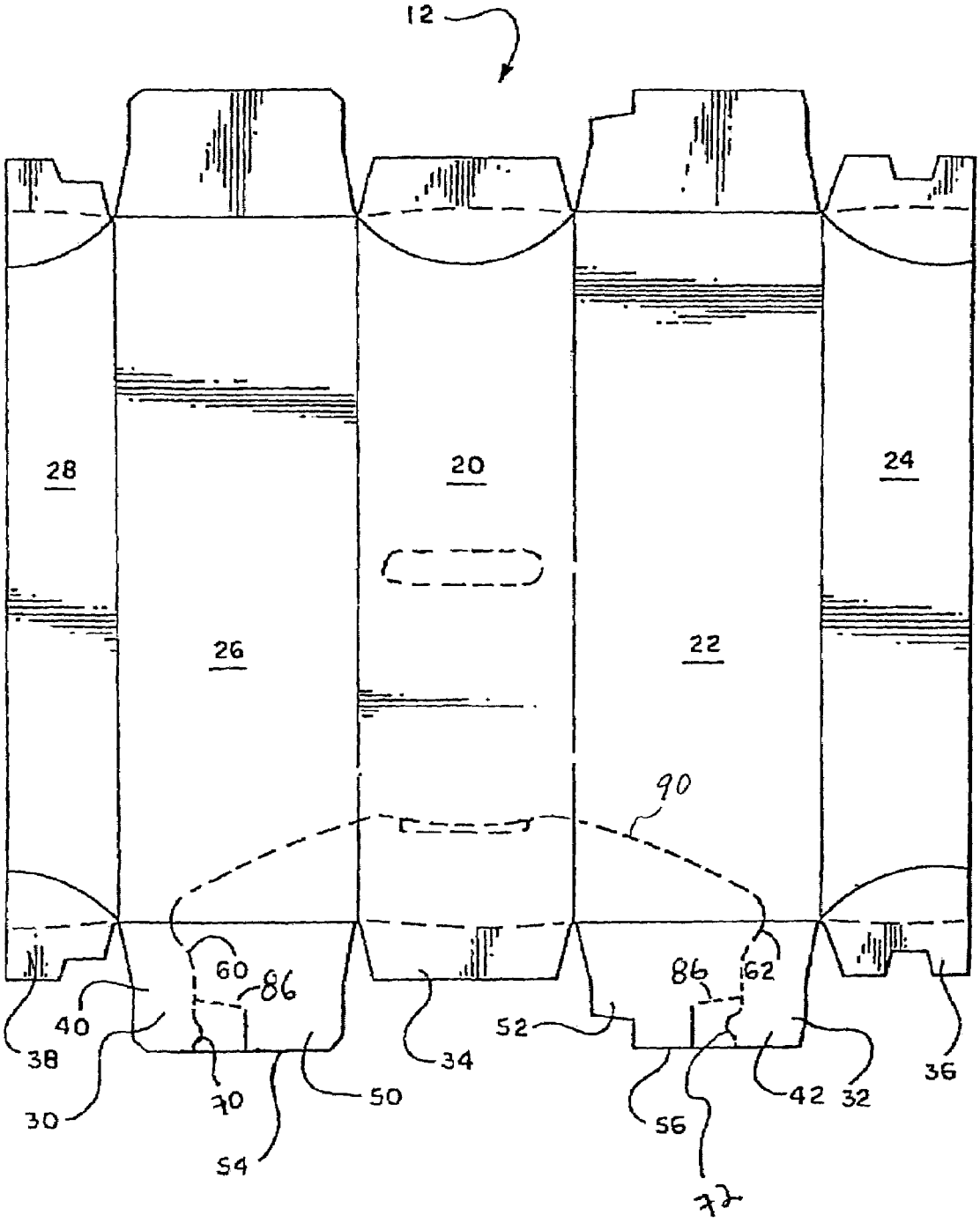
FIG. 1 illustrates a plan view of one embodiment of a blank for forming the carton of the present invention having a dispenser with an opening assist.

Referring now to the drawings in which like numerals indicate like elements throughout the several views, the drawings illustrate an exemplary embodiment of a dispensing carton 10 of the present invention. In one embodiment, the dispensing carton 10 is a carton for dispensing articles such as beverage cans.

Generally described, the carton 10 is formed from a blank 12 (FIG. 1) of foldable material such as paperboard. The blank 12 includes five primary panels for forming the carton 10.

The primary panels of the blank 12 are a center top panel 20, side panels 22, 26 and bottom panels 24, 28. These primary panels, as shown in FIG. 1, are hingedly connected in series to one another along fold lines. End closure structures are formed from what are typically referred to as major and minor flaps such as at 30, 32, 34, 36, 38. The terms "flap" and "panel" may be used interchangeably. The bottom panels 24, 28 are interconnected so that the primary panels 20, 22, 24, 26, 28 form the basic tubular structure of the erected dispensing carton 10.

Figure 3:
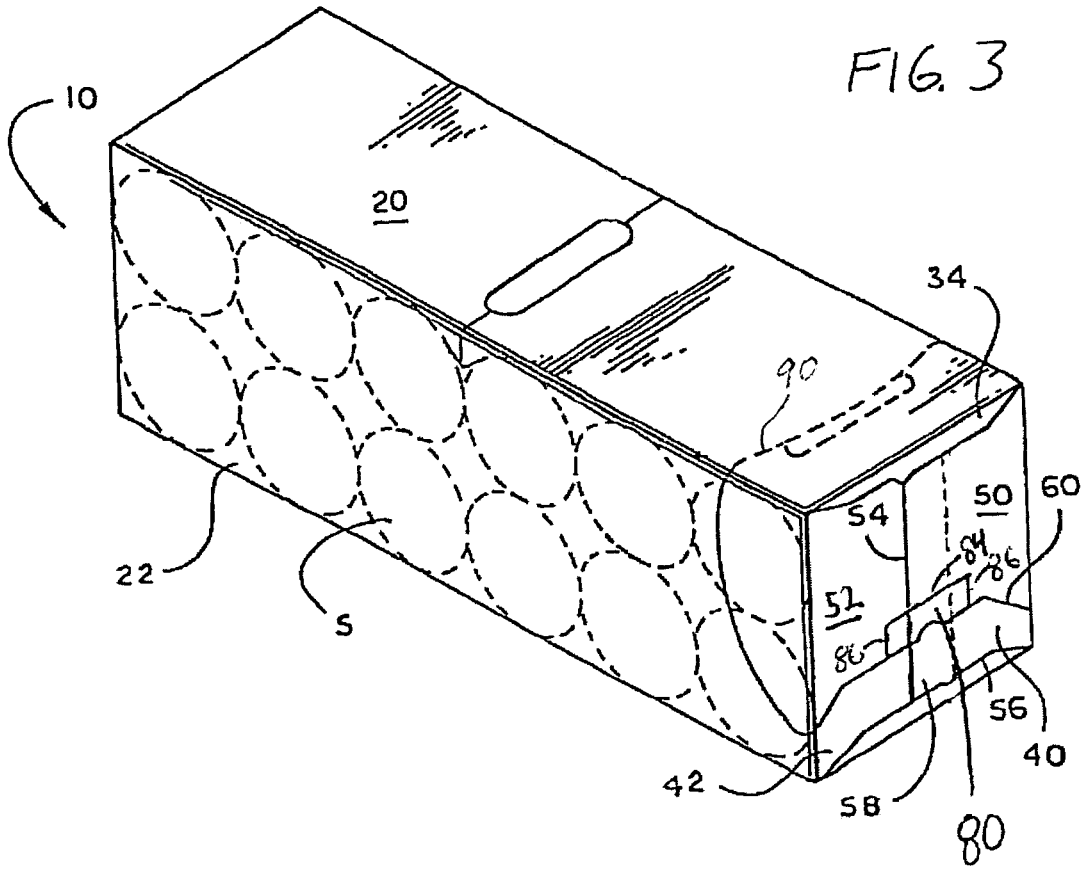
FIG. 3 is a perspective view of the carton of the present invention formed from the blank of FIG. 1.
Figure 5:
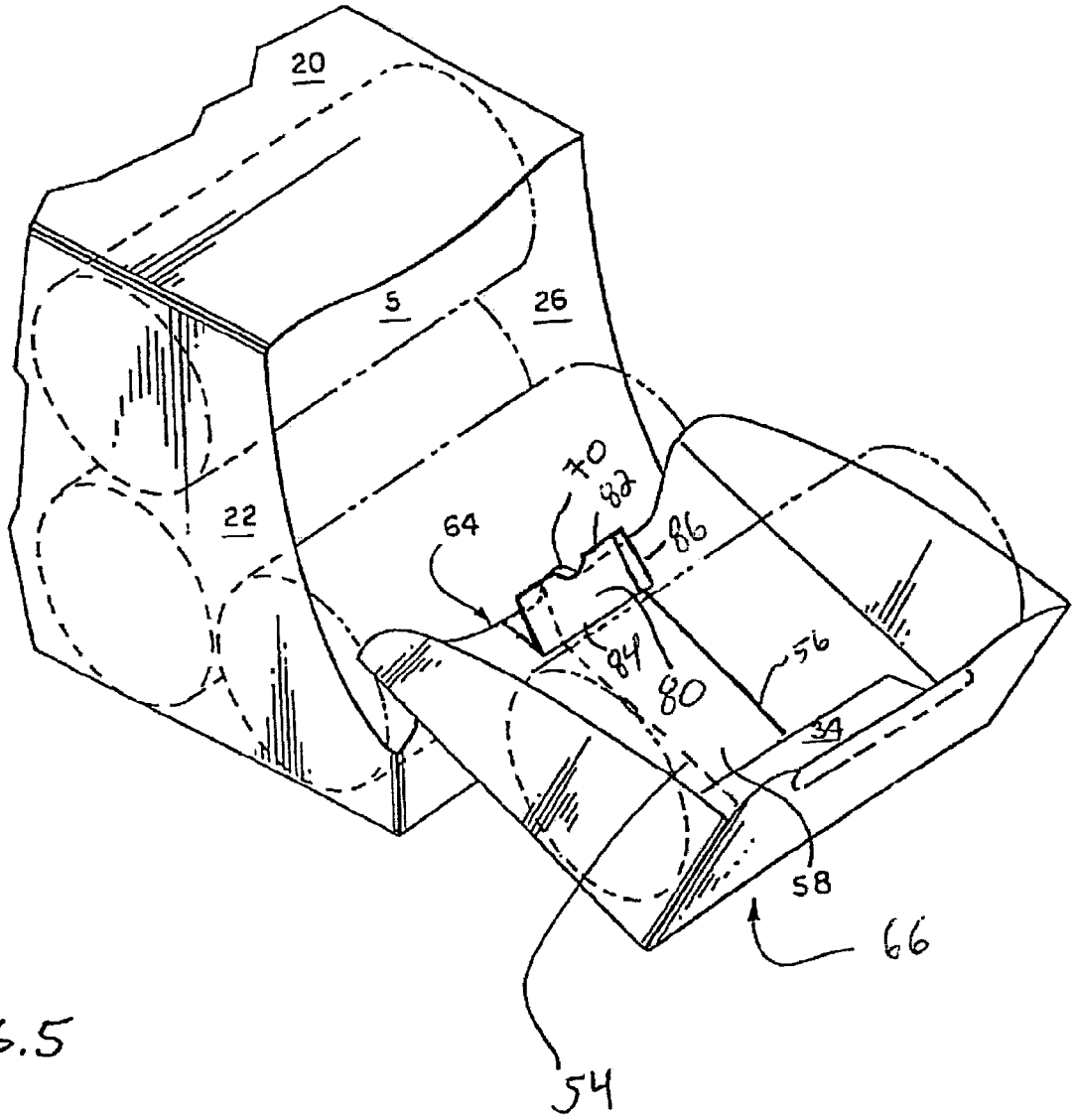
FIG. 5 is a fragmentary perspective view of the carton of FIG. 3 wherein a trough hinged to the carton has been folded down.

The carton 10 illustrated in the drawings is adapted to hold a group of similarly dimensioned, cylindrical articles S (such as cans or bottles), in a plurality of vertically arranged rows (two rows in FIGS. 3 and 5). The articles S in each row are disposed on their sides in a side-by-side parallel fashion. The side panels 22, 26 are disposed alongside the ends of the articles of the group while each end flap of the carton is disposed adjacent to the side walls of the respective endmost articles.

One of the opposite ends of the carton 10 is an exit end from which the articles S may be dispensed. At the exit end, major flaps 30 and 32 extend from side panels 26 and 22, respectively. Minor flaps 34, 36, 38 provide innermost closure for the dispensing end of the carton 10. Major flap 30 includes lower portion 40 and upper portion 50. Major flap 32 includes lower portion 42 and upper portion 52. Closure of the dispensing end of the carton 10 is accomplished by securing the distal ends of major flaps 30 and 32 to one another in an overlapping relationship as well as by securing either or both of major flaps 30 and 32 to minor flaps 34, 36, 38. The overlap of the distal ends of the major flaps 30, 32 creates a seam 58 (FIGS. 3–6) defined between end edges 54 and 56 of major flaps 30 and 32, respectively.

Figure 2:
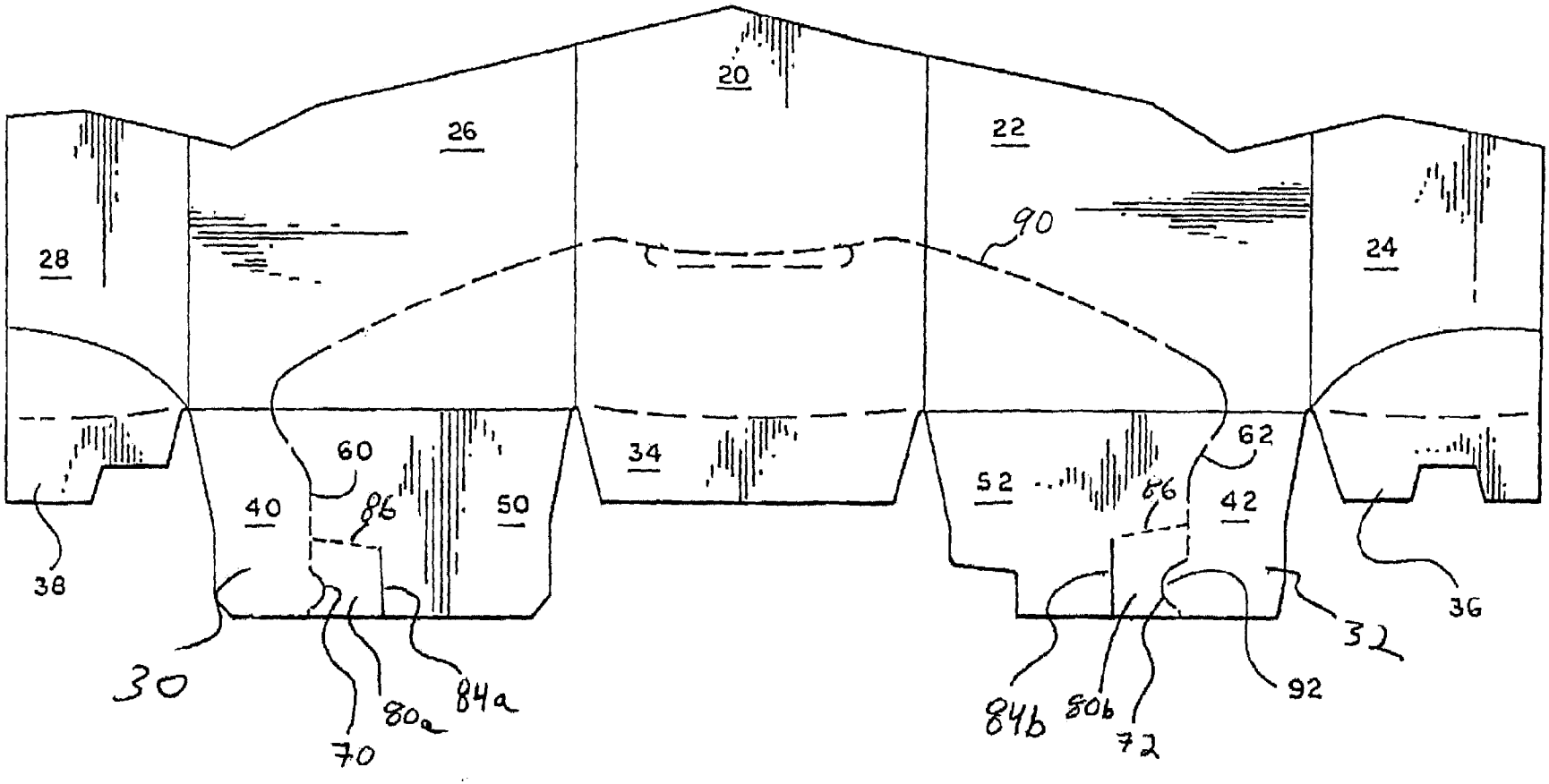
FIG. 2 is an enlarged plan view of the blank of FIG. 1.

As best shown in FIGS. 1 and 2, a frangible line 90 extends across each major panel 30 and 32, side panels 26 and 22, and center top panel 20. The length of the frangible line 90 in the center top panel 20 is displaced from the exit end of the carton 10. Portions of the carton that lie on either side of the frangible line 90 may be severed from one another. The lengths 60, 62 of the frangible line 90 in the major end flaps 30, 32 together create a hinge 64 (FIG. 5) about which opposing carton portions may be pivoted with respect to, or severed from, one another.

The lengths 60, 62 are used as references for defining the lower portions 40, 42 and upper portions 50, 52 of the major flaps 30, 32. The frangible line 90 may be a line of severance or any other weakened line that facilitates separation of the panel portions lying on either side of the frangible line 90. However, the "frangible line" in this application refers to a perforated line which is formed in the foldable sheet material from which the carton is formed and functions to split a part of the material in two. The "perforated line" refers to a line consisting of a series of short slits or cuts arranged at spacings, or a single cut line divided by one or more nicks into two or more line segments, and ready to split along the line when subject to external force.

Figure 6:
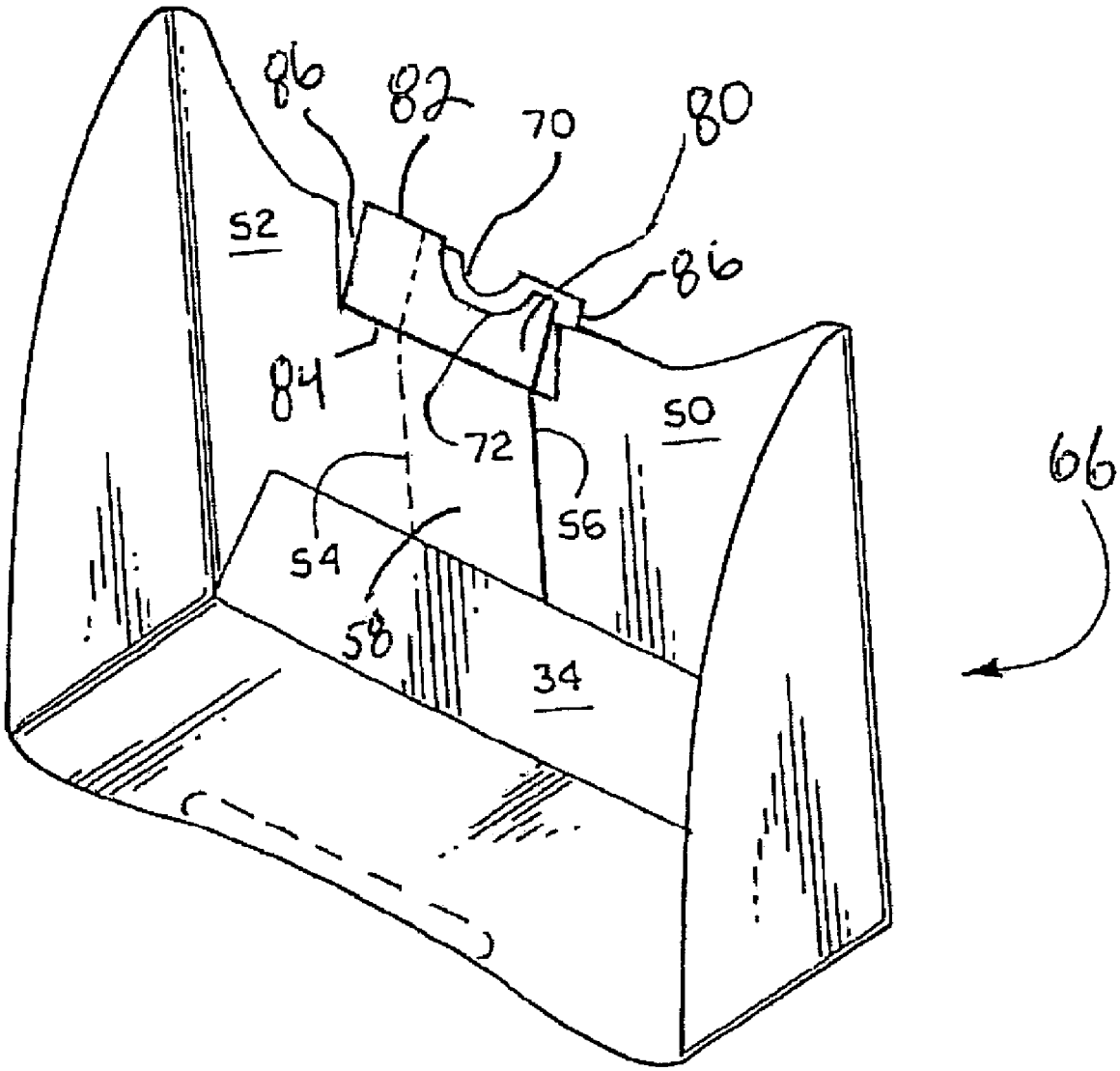
FIG. 6 is a perspective view of the trough of FIG. 5 having been removed from the remainder of the carton.

The frangible line 90 terminates at free end edges 54 and 56 of major flaps 30 and 32, respectively. The full extension of the frangible line 90 defines a displaceable portion 66 of the carton 10 commonly referred to as a trough (FIGS. 5 and 6). The displaceable portion 66 is at least partially separable from the carton 10 to permit dispensing of the articles S from the carton 10. The length 60, 62 of frangible line 90 may be used to allow the trough 66 to be pivoted about themselves or to allow the upper portion 50 of the major flap 30 and the upper portion 52 of the major flap 32 to be removed from the erected carton 10. The upper portions 50, 52 removed from the major flaps 30, 32, along with portions of the side panels 22, 26 and the center top panel 20, define the displaceable portion or trough 66.

Each length 60, 62 of the frangible line 90 that extends across the seam 58 is preferably extensively more weakened than the remainder of the frangible line 90 to allow easier separation across the seam 58 between lower portions 40, 42 and upper portions 50, 52.

Weakened line segments that are parts of the respective lengths 60, 62 of the frangible line 90, preferably include arcuate portions 70 and 72 as best shown in FIG. 2. The arcuate portions 70 and 72 are positioned so as to substantially correspond with one another to partially form the frangible line 90 when the major flaps 30, 32 are overlapped and joined together. Also, weakened line segments are preferably created by a full cut line or a cut line sparingly interrupted by one or more nicks. In one embodiment, the arcuate portions 70 and 72 of the weakened line segments may be offset somewhat from one another.

Figure 4:
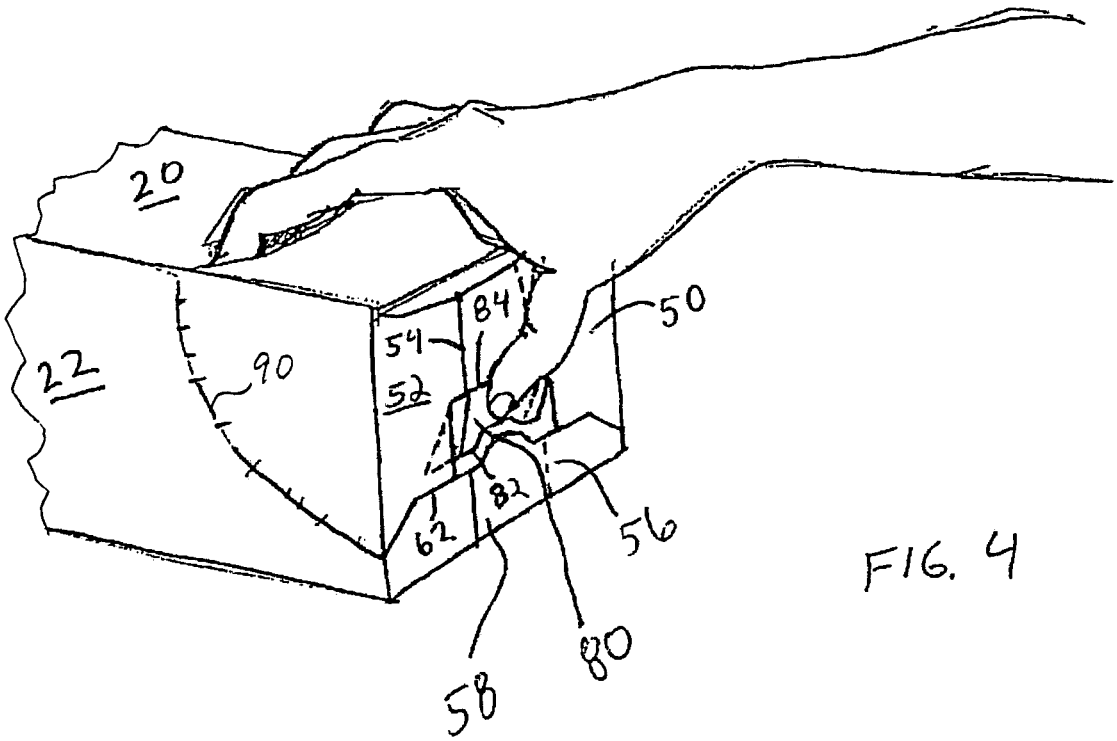
FIG. 4 is a fragmentary perspective view of the carton of FIG. 3, illustrating the positioning of the thumb for utilizing an opening assist formed in the carton end.

The present invention further includes an opening assist 80 as best shown in FIGS. 3 and 4. The opening assist 80 facilitates the opening of the dispensing carton 10 along the lengths 60, 62 of the frangible line 90 without unintentionally tearing the dispensing carton 10. In the embodiment of FIGS. 3 and 4, the opening assist 80 is a push tab traversing the seam 58 and that is partially defined along the frangible line 90. As shown in FIGS. 4 and 5, a distal end 82 of the opening assist 80 corresponds with or borders the line segments of the frangible line 90 including the arcuate portions 70, 72.

The opening assist 80 also includes a hinged end 84 and opposed side edges 86 and 86. The hinged end 84 is defined across the seam 58 by fold lines 84*a* and 84*b*, as apparent from FIGS. 2, 3 and 5. The opening assist 80 is formed in part from the major flap 30 and in part from the major flap 32. The portion of the opening assist 80 formed from the major flap 30 is designated by reference numeral 80*a* while the other portion from the major flap 32 is designated by numeral 80*b* (FIG. 2). The side edge 86 and fold line 84*a* on major flap 30 define the portion 80*a* (FIG. 2) whereas the other side edge 86 and fold line 84*b* define the portion 80*b*. The side edges 86 are formed of tear lines in the upper portions 50, 52 of the major flaps 30, 32. The tear line 86 in the major flap 30 extends between the fold line 84*a* and the length 60 of the frangible line while the tear line 86 in the major flap 32 extends between the fold line 84*b* and the length 62 of the frangible line 90. Portions 80*a* and 80*b* combine to form the opening assist 80 as shown in FIGS. 3 and 5 when the dispensing carton 10 is erected.

The hinged end 84 is displaced from the edge of the trough 66 defined by the separated lengths 60, 62 of the frangible line 90. The fold lines 84*a*, 84*b* preferably extend beyond the width of seam 58. In an alternative embodiment, the hinged end 84 of the opening assist 80 is positioned on the lower portions 40, 42 of the major flaps 30, 32, rather than on the upper portions 50, 52. In such case, the distal end of the opening assist 80 would include the portions of the carton end defined by weakened line segments of the frangible line 90. Such an opening assist 80 would be pivoted about the hinged end 84 and extend into the opening of the carton 10 for dispensing the articles when pressure is applied and broken open.

Applying pressure to the opening assist 80, as shown in FIG. 4, to separate the distal end 82 from the frangible line 90 and the opposed side edges 86 and 86 from the upper portions 50, 52 of the major panels 30, 32, allows the trough 66 to more easily pivot along the hinge 64 (FIG. 5) without resistance from the seam 58. Also, pushing through the opening assist 80, allows the trough 66 to be more easily detached from the carton 10 without resistance from the seam 58 because the lower portions 40, 42 and upper portions 50, 52, along the seam 58, are separated from one another before the other portion of the trough 66 is severed from the carton 10.

The opening assist 80 may be pushed through to tear the portion of the frangible line 90, corresponding with the distal end 82, prior to initiating removal of the trough 66, as shown in FIG. 4. In such case, the perforation that would otherwise be broken last when tearing out the trough 66 would be broken first to prevent unintended tears. Removal of the trough 66 by pulling down on the top of the carton 10 would then follow.

On the other hand, the opening assist 80 may instead be pushed through to tear the portion of the frangible line 90 corresponding with the distal end 82, following the initial removal or the pulling down of the trough 66 from the center top panel 20. In any case, the remaining portion of the frangible line 90, defining a portion of the hinge 64, remains unbroken until complete removal of the trough 66 from the dispensing carton 10 is desired.

The present invention has been illustrated in relation to a particular embodiment which is intended in all respects to be illustrative rather than restrictive.

It will be recognized that as used herein, directional references such as "top", "bottom", "end", "side", "upper", "lower", "inner" and "outer" do not limit the respective panels to such orientation, but merely serve to distinguish these panels from one another. Any reference to hinge or hinged connection should not be construed as necessarily referring to a single fold line only: indeed it is envisaged that hinge or hinged connection can be formed from one or more of one of the following, a score line, a frangible line or a fold line, without departing from the scope of invention.

It should be recognized that numerous changes may be made within the scope of the invention. In particular, it should be apparent to a person skilled in the art that the opening assist described above may be applied to a wide variety of carton types for example wraparound cartons, top gripping cartons or other such cartons in which it is necessary for the carton to be torn open without unintended paper tears while continuing to facilitate easy access to the articles to be dispensed from the carton.

What is claimed is:

1. A carton for dispensing articles, comprising:

a plurality of panels defining an end of said carton;

a seam formed from at least a pair of said panels and defined in said end of said carton;

a displaceable portion detachably connected to said carton end to be at least partially detached from said carton for exposing an endmost article for removal from said carton, said displaceable portion at least partially defined by a frangible line in said carton end; and an opening assist defined in said end of said carton such that said opening assist at least partially traverses said seam, wherein said opening assist comprises a push tab defined at least in part by a segment of said frangible line, said segment extending entirely across said seam to facilitate detachment of said displaceable portion along said segment, said push tab being hingedly connected to said displacable portion to be movable from an initial position to a pushed position where said push tab extends into said carton, said push tab being formed at least in part from said displacable portion such that a recess is defined in said displacable portion upon movement of said push tab into said pushed position.

2. The carton of claim 1 wherein said segment of said frangible line defines a distal end of said push tab.

3. The carton of claim 1 wherein said segment of said frangible line is torn prior to tearing the remainder of said frangible line to open said dispensing carton for dispensing articles.

4. The carton of claim 1 wherein said push tab is at least partially defined by a fold line about which said push tab is hingedly connected to said displaceable portion, and wherein said fold line and said segment of said frangible line are displaced from one another.

5. The carton of claim 4 wherein said fold line is defined on said displaceable portion.

6. The carton of claim 4 wherein said push tab is defined in said displaceable portion and displaced from said initial position to said pushed position when pressure is applied thereto.

7. The carton of claim 4 wherein said push tab is defined further by a pair of tear lines each extending between said fold line and said segment of said frangible line.

8. The carton of claim 1 wherein said frangible line is a line of severance permitting said displaceable portion to be detached from said carton.

9. The carton of claim 4 wherein said segment of said frangible line defines a distal end of said push tab, said distal end corresponding with a part of an edge of said displaceable portion defined by separation of said displaceable portion from said carton along said frangible line.

10. A trough having been formed from an end of a dispensing carton and having been detached from said dispensing carton along a frangible line on said dispensing carton, said trough having a fold line displaced from said frangible line along the entire length of said frangible line, and said fold line partially defining a push tab having a distal end corresponding with a portion of an adiacent edge of said trough defined by the separation of said trough from said dispensing carton along said frangible line, wherein the trough further comprises a seam defined by end edges of panels that overlap one another to form said end of said dispensing carton, said push tab being disposed traversing said seam.

11. The trough of claim 10 wherein line segments of each said overlapping panel correspond with one another to partially define said frangible line.

12. A dispensing carton comprising:

a center top panel;

a side panel connected along a told line to each opposing edge of said center top panel, each of said side panels having an end flap for at least partially defining a carton end of said carton, said end flaps overlapping one another to define a seam in said carton end;

a bottom panel connected along a fold line to each side panel at an edge thereof opposite said center top panel;

a displaceable portion detachably connected to said carton end to be at least partially detached from said carton for exposing an endmost article for removal from said carton end, said displaceable portion at least partially defined by a frangible line on said carton end; and an opening assist defined in said carton end, a distal end of said opening assist at least partially bordering said frangible line and traversing said seam, said opening assist comprises a push tab being hingedly connected to said displaceable portion to be movable from an initial position to a pushed position where said push tab extends into said carton, said push tab being formed at least in part from said displaceable portion such that a recess is defined in said displaceable portion upon movement of said push tab into said pushed position.

13. The carton of claim 12 wherein said push tab is at least partially defined by a fold line about which said push tab is hingedly connected to said displaceable, and wherein said fold line and said distal end of said opening assist are displaced from one another.

14. The carton of claim 13 wherein said fold line is defined on said displaceable portion.

15. The carton of claim 13 wherein said push tab is defined further by a pair of tear lines each extending between said fold line and said distal end.

16. The carton of claim 13 wherein said displaceable portion comprises a separable trough having been formed at least from said carton end, said fold line being displaced from an edge of said trough, said distal end of said opening assist corresponding with a part of said edge of said trough defined by separation of said trough from said carton along said frangible line.

17. The carton of claim 16 wherein said trough comprises a part of said seam.

18. The carton of claim 16 wherein said trough is further formed from said top and side panels.

* * * * *